United States Patent [19]

Foster

[11] 4,309,800

[45] Jan. 12, 1982

[54] FELTING NEEDLE

[75] Inventor: Edson P. Foster, Cato, Wis.

[73] Assignee: Foster Needle Co., Manitowoc, Wis.

[21] Appl. No.: 63,294

[22] Filed: Aug. 2, 1979

[51] Int. Cl.[3] ..... D04H 18/00

[52] U.S. Cl. ..... 28/115

[58] Field of Search ..... 28/115; 223/102, 104

[56] References Cited

U.S. PATENT DOCUMENTS

| | | | |
|---|---|---|---|
| 114,446 | 5/1871 | Kenney | 223/104 X |
| 232,962 | 10/1880 | Harrington | 28/115 X |
| 3,022,813 | 2/1962 | Glover | 28/115 X |
| 3,025,586 | 3/1962 | Wells | 28/115 X |
| 3,050,896 | 8/1962 | Parker | 223/104 X |
| 3,605,223 | 9/1971 | Barth | 28/115 |
| 3,680,182 | 8/1972 | Scott | 28/115 |
| 3,727,276 | 4/1973 | Foster | 28/115 |
| 3,729,785 | 5/1973 | Sommer | 28/115 |
| 3,792,512 | 2/1974 | Zocher | 28/115 |
| 4,110,875 | 9/1978 | Foster | 28/115 |

FOREIGN PATENT DOCUMENTS

| | | | |
|---|---|---|---|
| 759140 | 4/1971 | Belgium | 28/115 |
| 720664 | 5/1942 | Fed. Rep. of Germany | 223/102 |
| 2038478 | 2/1972 | Fed. Rep. of Germany | 28/115 |
| 51-12109 | 4/1976 | Japan | 28/115 |
| 51-19509 | 6/1976 | Japan | 28/115 |
| 266456 | 2/1927 | United Kingdom | 28/115 |
| 1304732 | 1/1973 | United Kingdom | 156/148 |

*Primary Examiner*—Robert Mackey

*Attorney, Agent, or Firm*—Francis J. Bouda

[57] ABSTRACT

A felting needle having a wedge-like tip with an open double barb formed in the leading edge of the tip. The double barb includes a pair of opposed outwardly diverging fiber-engaging surfaces with precisely formed angles. One outwardly diverging barb angle extends to one side of the needle, and the other outwardly diverging barb angle is disposed symmetrically and diametrically opposite thereto. Unlike ordinary barbs formed in a lateral edge of a felting needle, the double-barb of the present invention allows fibers to slip off to either side of the needle and thus prevent fiber damage.

3 Claims, 8 Drawing Figures

FELTING NEEDLE

BACKGROUND OF THE INVENTION

In the past, felting needles have been grouped in two general types. The first type is the regular felting needle with a round, pointed end and barbs spaced at various points along the lateral edge of the blade. Such a needle is designed to interlock fibers so as to produce a felted fabric. The second type of needle is the forked needle which has two spaced-apart points and a fiber receiving slot between them for pushing fibers toward a batt. The primary function of such a needle is to embellish the surface of felted fabrics.

Patents which illustrate needles in the first group are my own U.S. Pat. Nos. 3,307,238; 3,641,636; 3,815,186; 3,844,004; and 4,156,305; and patents which illustrate needles in the second group are my own U.S. Pat. Nos. 3,727,276 and 4,110,875. The older, long-established felting needle with barbs formed in longitudinal lateral edges of the needle body have long been known, and specific terminology has become identified with such needles, such as barb angle, throat depth, kickup and throat length. Such portions of a felting needle must be held to very close tolerances to make possible the production of the desired fabric. Barb angles, with their precise forward inclination, are very critical. It is essential on the regular felting needle that the barb angle be such that engaged fibers can shed off the barb tip and be felted into the fabric. The design of the forked needle with longitudinal sidewalls adjacent the fiber-receiving slot makes shedding impossible and confines the function of the needle to the production of fiber loops and tufts.

SUMMARY OF THE INVENTION

In the present invention, in order to overcome the disadvantages of the felting needles or the tufting needles of the prior art, I provide a unique barb structure at the forward tip of the needle. This I have identified as an "open double-barb."

In one embodiment, the needle has a spatulate or wedge-shape tip, with a barb which has two forwardly-inclined barb angles diametrically opposed to each other across the centerline of the needle. The two symmetrical barb angles cooperate to provide a single fiber-engaging indentation at the leading edge of the needle.

Contrary to the ordinary barb formed in the lateral edge of a needle body, this symmetrical open double-barb with its "positive" but very slight barb angle allows the fibers to slip off to either side of the needle when the indentation is "loaded" with fibers. This clearly distinguishes from the standard barb heretofore known in the art wherein the barb with its lateral throat in the needle body prevents the fibers from slipping off with resultant damages to the fibers.

In another embodiment the barb angle can be zero degrees (i.e., at 90° to the centerline of the needle), and in a third embodiment a "negative" barb angle is provided, each of which afford even greater ability to shed the fibers and prevent fiber damage.

Because the open double-barb is formed on the tip of the needle, it always accepts fibers and thus the needle always "loads". The loading can be controlled by the barb angle. Also, because of its location, the open double-barb only needs to penetrate the bed plate and thus considerable needle breakage is eliminated. A further attraction of this needle is that because of its construction, the length of the needle stroke is shortened.

Another advantage of the double barb is that it can consistently pick up extremely small punching loads, and since small punching loads are the only way to eliminate needle marks and craters in the fabric, the open double-barb needle of the present invention produces a much finer and more attractive fabric.

In addition, because the needle does not enter the bed plate, the full capacity of the needle loom is utilized, and this means that a higher number of strokes per minute and thus higher density needle board providing higher fabric production is available.

Therefore, it is an object of the present invention to provide a felting needle with an open double-barb at its forward end which permits fibers to slip off the barb and which prevents fiber breakage.

Another object of the present invention is to provide a barb at the point of the needle which is always open to accept fibers and, therefore, always "loads."

Another object of the present invention is to provide a needle structure which reduces needle breakage because the needle does not have to enter a bed plate on the back side of the fabric being punched.

Finally, an object of the present invention is to provide a felting needle with a pair of opposed barb angles in the tip thereof to provide a single fiber-engaging surface.

With the above and other objects in view, more information and a better understanding of the present invention can be achieved by referring to the following detailed description:

DETAILED DESCRIPTION

For the purpose of illustrating this invention, there is shown in the accompanying drawings several forms thereof which are at present preferred, although it is to be understood that the various instrumentalities of which the invention consists can be variously arranged and organized and that my invention is not limited to the precise arrangements and organizations of the instrumentalities as herein shown and described.

In the drawings wherein like reference characters indicate like parts:

Figure 1:
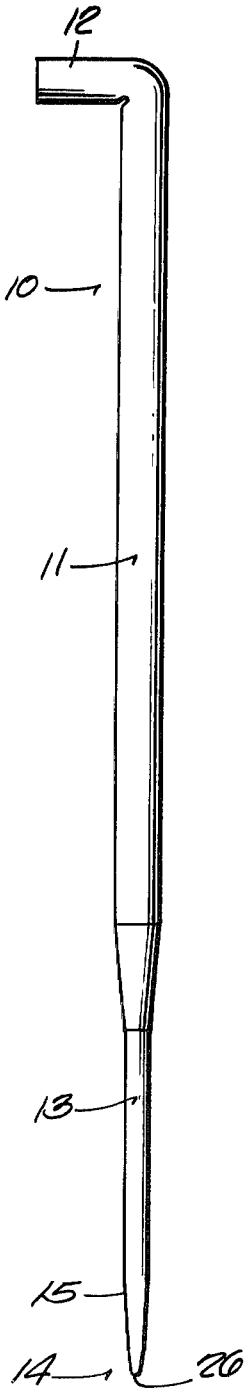
FIG. 1 is a side elevational view of a felting needle having the open double-barb of the present invention.

Felting needles, like the felting needle 10 of the present invention, generally include a shank 11, a crank 12, and a blade 13. The blade 13 may be circular in cross section with its end tapered to a tip 14. It is at this tip 14 that the open double-barb of the present invention is formed.

Figure 2:
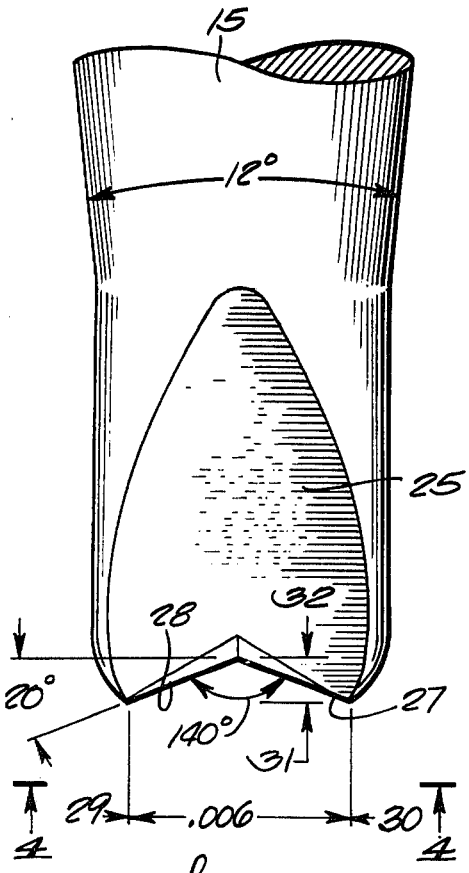
FIG. 2 is a greatly enlarged fragmentary front elevational view of the tip of the felting needle, showing the details of the open double-barb.

For the purpose of illustrating this invention, the drawings must be greatly enlarged, and it is to be understood that felting needles of which this invention is illustrative, are made of relatively fine wire. For instance, the felting needle of the present invention may be a 32 gauge needle, which is approximately 0.026" in diameter. The blade 13 shown in the drawings of FIG. 1 appears much larger than 0.026" in diameter, and FIG. 2 and 3 are shown on a scale of approximately ¼" to 0.001".

The end of the blade 13, where it tapers to the tip 14, is ground in the shape of a cylindrical cone at 15. The included angle of this portion 15 is 12°, as is shown particularly in FIGS. 2 and 3, and the point of the tip preferably is 0.006" in diameter. This dimension is shown in dotted lines in FIG. 3.

Figure 5:
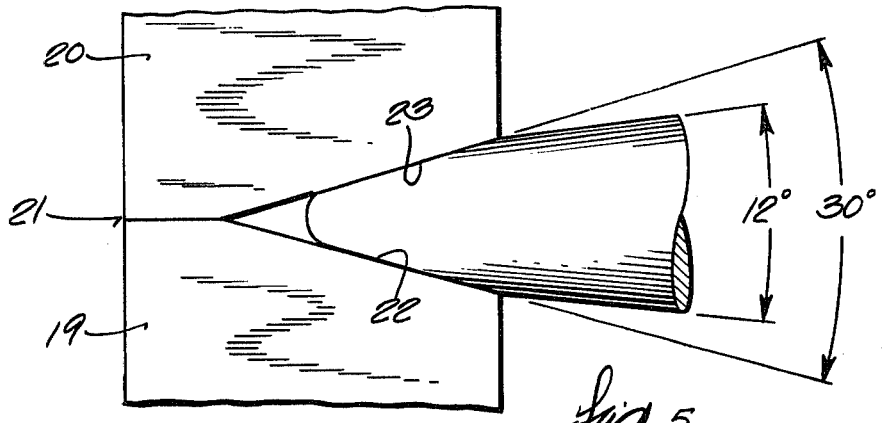
FIG. 5 is a schematic diagram of the tool used to form the flat wedge-shaped portion of the tip of the open double barb of the present invention.

Thereafter, I form a wedge-shaped portion in the tip of the needle by use of a swaging tool illustrated schematically in FIG. 5. This tool may include a lower stationary portion 19 and an upper movable portion 20, which come together at the meeting line 21. Each of the portions 19 and 20 has an angular surface 22 and 23, respectively, ground therein at an angle of 15° to provide an included angle between the two tool portions of 30°.

Figure 3:
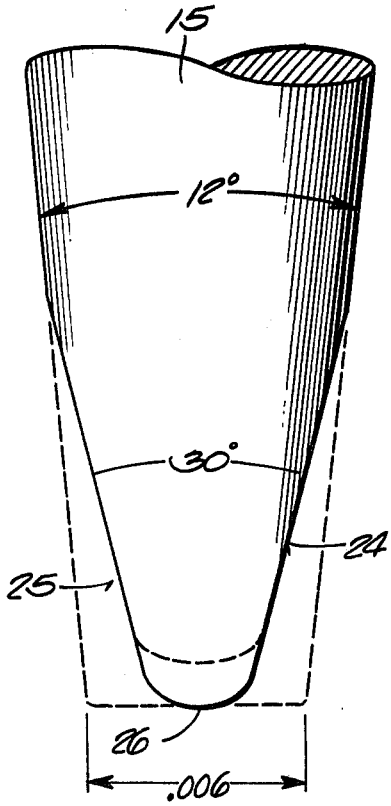
FIG. 3 is a side elevational view of the tip of the needle of FIG. 2.
Figure 4:
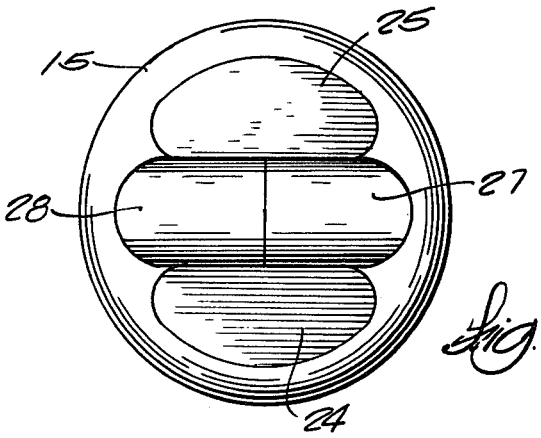
FIG. 4 is an end elevational view taken generally along line 4—4 of FIG. 2.

Then the tip of the needle is placed between the swaging tool portions 19 and 20, whereupon the tools are brought together to flatten the needle tip between the surfaces 22 and 23, to form a spatulate wedge-shaped portion, defined by the surfaces 24 and 25 as shown in FIGS. 3 and 4.

During formation of the wedge-shaped portion, the outermost end of the tip is not only flattened (to provide the surfaces 24 and 25), but it also may expand slightly sidewardly beyond the 0.006" dimension, as is illustrated in FIG. 2.

Thereafter, in one embodiment illustrated in FIG. 2, I form a 140° included angle in the wedge edge 26. This can be done either by swaging or by grinding, but it will be clearly noted from the illustrations in FIG. 2, and particularly in FIG. 3, there are no sharp corners and the wedge-edge is a smoothly rounded surface.

Figure 6:
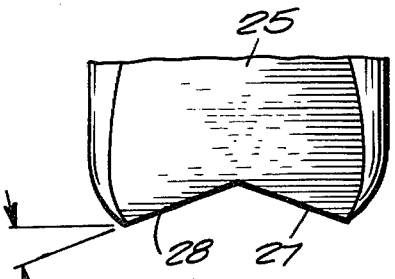
FIG. 6 is a fragmentary front elevational schematic view of the needle tip of FIG. 2, illustrating "positive" barb angles.

The open double-barb illustrated in FIGS. 2 and 6 includes one surface 27 and another surface 28. The throat length of approximately 0.006" is shown between the arrows 29 and 30 in FIG. 2.

The throat depth of approximately 0.0015" is indicated between the arrows 31 and 32.

Thus I have provided a felting needle with a body portion having a wedge edge front end. In one embodiment, that wedge edge is the forwardly directed fiber-engaging open double-barb located equally on each side of the centerline of the needle. It consists of opposed symmetrical outwardly and forwardly extending surfaces which engage the fibers to be felted. The indentation may be curved or generally concave, or it may be angular, and I have chosen to illustrate an angle between the fiber-engaging surfaces of 140°. This design is specifically intended to felt the fibers uniformly on both sides of the needle.

In the embodiment illustrated in FIG. 6, the indentation formed by the surfaces 27 and 28 provides positive barb angles which may vary from 0° to 30°, and I have illustrated a 20° angle.

Figure 7:
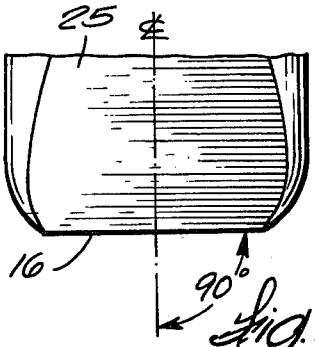
FIG. 7 is a view similar to FIG. 6, illustrating zero barb angles.

In the embodiment illustrated in FIG. 7, the barb angles are 0°, that is, the leading edges of the open double barb are in alignment and disposed at a 90° angle to the centerline of the needle, as is illustrated at 16 in FIG. 7.

Figure 8:
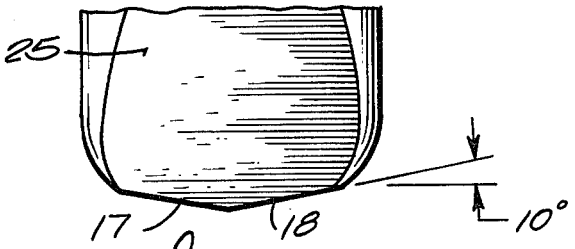
FIG. 8 is a view similar to FIGS. 6 and 7 illustrating negative barb angles.

In FIG. 8, I illustrate still another embodiment wherein negative barb angles are chosen and surfaces 17 and 18 can be disposed at a negative angle of between 0° to 30°. In FIG. 8 I have illustrated a negative angle of 10°.

With the conventional throated-barb felting needle, the fabric can be entangled and compacted just so far and a point is reached where further needling becomes counter-productive. At this point the barb engages and holds fibers already entangled into the fabric, there is no give, and the continuing downward needle action breaks the engaged fibers. With the provision of a felting needle such as shown in FIGS. 7 and 8, there is no throat or pocket that holds fibers. These needles provide a front end fiber engaging surface having the configuration and needle action of a sliding cam which imparts a transient friction motion to work the fibers into the fabric and thus increase its density without fiber or fabric damage.

It is clear that this open double-barb configuration does not include any kickup. Because the double-barb is on the wedge-edge of the needle, and open to accept fibers, it always "loads." Furthermore, because of its location, the open double barb need penetrate only through the batt of fibers, and it does not enter the bed plate. Thus considerable needle breakage is eliminated.

The open double-barb wedge edge needle of this invention thus eliminates needle marks and craters in the fabric and permits more rapid operation of the felting machine, and along with this high density performance, improved operation, better productivity and a better quality of finished product is insured.

It is to be understood that the present invention may be embodied in other specific forms without departing from the spirit or special attributes hereof, and it is therefore desired that present embodiments be considered in all respects as illustrative and therefore not restrictive, reference being made to the appended Claims rather than the foregoing description to indicate the scope of the invention.

Having thus described my invention what I claim is new and desire to protect by Letters Patent are the following:

1. A felting needle having a body portion with a wedge edge at its front end, a forwardly-directed fiber-engaging open double barb in the wedge edge, said double barb being a substantially symmetrical indented configuration having opposed outwardly and forwardly diverging fiber-engaging surfaces, and wherein the outwardly and forwardly diverging fiber engaging surfaces provide between them an included angle of between 120° and 180°, and wherein the wedge edge is formed between two converging wedge surfaces having an included angle between them of 30°, and wherein the wedge edge is formed in a conical tip of the felting needle, the conical tip having a taper of between 7°–15° and being substantially circular in cross section.

2. A felting needle having a body portion with a wedge edge at its front end, a forwardly-directed fiber-engaging open double barb in the wedge edge, said double barb being a substantially symmetrical indented configuration having opposed outwardly and forwardly diverging fiber-engaging surfaces, and wherein the outwardly and forwardly diverging fiber-engaging surfaces provide between them an included angle of between 120° and 180°, and wherein the wedge edge is formed between two converging wedge surfaces, and wherein the wedge edge is formed in a conical tip of the felting needle, the conical tip having a taper of between 7°–15° and being substantially circular in cross section.

3. A felting needle having a body portion with a wedge edge at its front end, a forwardly-directed fiber-engaging open double barb in the wedge edge, said double barb being a substantially symmetrical indented configuration having opposed outwardly and forwardly diverging fiber-engaging surfaces, and wherein the outwardly and forwardly diverging fiber-engaging surfaces provide between them an included angle of between 120° and 180°, and wherein the wedge edge is formed between two converging wedge surfaces, forming an acute angle, and wherein the wedge edge is formed in a conical tip of the felting needle, the conical tip having a taper of between 7°–15° and being substantially circular in cross section.

* * * * *